US007309066B2

(12) United States Patent
Donaldson

(10) Patent No.: US 7,309,066 B2
(45) Date of Patent: Dec. 18, 2007

(54) DOUBLE BLACK JACKS, A BLACKJACK TYPE GAME

(76) Inventor: Frederic Wayne Donaldson, 282 Big Lake Rd., Apt. 162, Biloxi, MS (US) 39531-3730

( * ) Notice: Subject to any disclaimer, the term of this patent is extended or adjusted under 35 U.S.C. 154(b) by 0 days.

(21) Appl. No.: 11/069,612

(22) Filed: Mar. 1, 2005

(65) Prior Publication Data

US 2005/0194742 A1 Sep. 8, 2005

Related U.S. Application Data

(60) Provisional application No. 60/549,302, filed on Mar. 2, 2004.

(51) Int. Cl.
*A63F 1/00* (2006.01)

(52) U.S. Cl. ..... 273/292; 273/274; 273/309; 463/12

(58) Field of Classification Search ..... 273/292, 273/309, 274, 308; 463/12, 13
See application file for complete search history.

(56) References Cited

U.S. PATENT DOCUMENTS 5,280,915 A * 1/1994 Groussman ..... 273/292
5,407,199 A * 4/1995 Gumina ..... 273/139
5,411,268 A * 5/1995 Nelson et al. ..... 273/292
5,702,104 A * 12/1997 Malek et al. ..... 273/292
5,806,846 A * 9/1998 Lofink et al. ..... 273/292

* cited by examiner

*Primary Examiner*—Benjamin Layno
(74) *Attorney, Agent, or Firm*—Charles F. Rye

(57) ABSTRACT

A casino wagering game where at least one player has the options to either place multiple wagers against a dealer and/or banker (the house) in a game, to qualify for a pre-determined Bonus schedule, or both. However, uniquely by the design of the present invention, each participating player is initially dealt three cards creating at least two separate hands. Specifically, one of those cards dealt to each player is considered a "shared card" in its relationship to each of the other two cards dealt to that player. Within the dealing, the house is dealt one hand of two cards. According to another aspect, the three cards initially dealt to each player, defined as at least two separate hands, may be treated separately in a Bonus game offered for an additional or separate wager. After the initial Bonus aspect of the game is resolved, a game defined by the house ensues.

10 Claims, 4 Drawing Sheets

PT
Bonus Bet Payouts (1st 3 Cards)
| | |
|---|---|
| Super Double Black Jacks | 400 |
| Double Black Jacks Bonus | 200 |
| Double Splits (AAA to 222) | 40 |
| Double Blackjack | 10 |
| Double 20's | 4 |
| Either Hand a Blackjack | 2 |
| Either Hand a Pair | 1 |
Figure 2
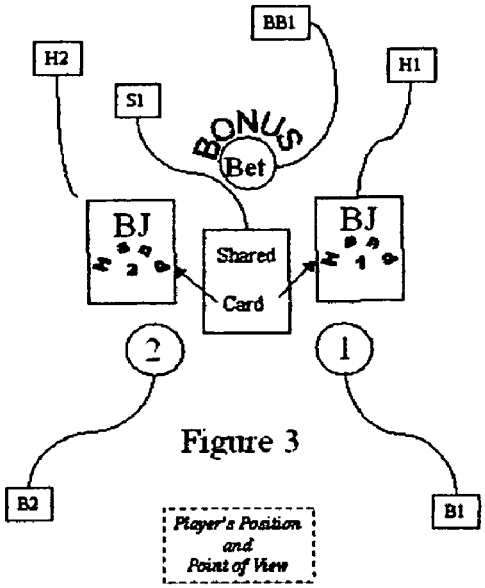
Figure 3
PT
Bet 3 Payouts (1st 3 Cards)
| | |
|---|---|
| Double Black Jacks | 500 |
| Double Aces Black Jacks | 100 |
| Double Splits (AAA to 222) | 10 |
| Double Blackjack | 10 |
| Double 20's | 3 |
| Either Hand a Blackjack | 2 |
| Either Hand a True Pair | 1 |
Figure 2 a.
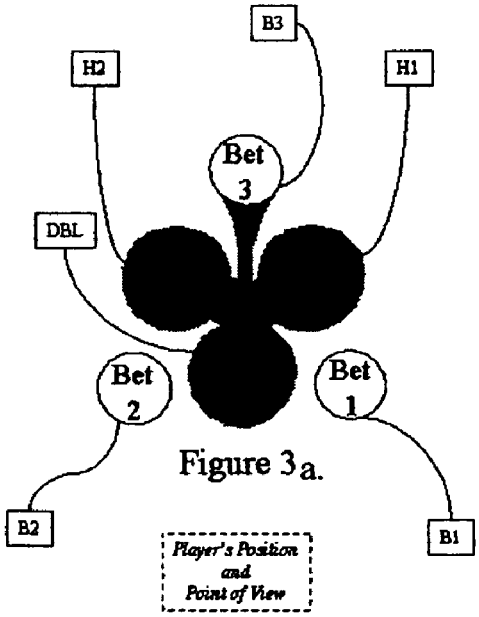
Figure 3 a.

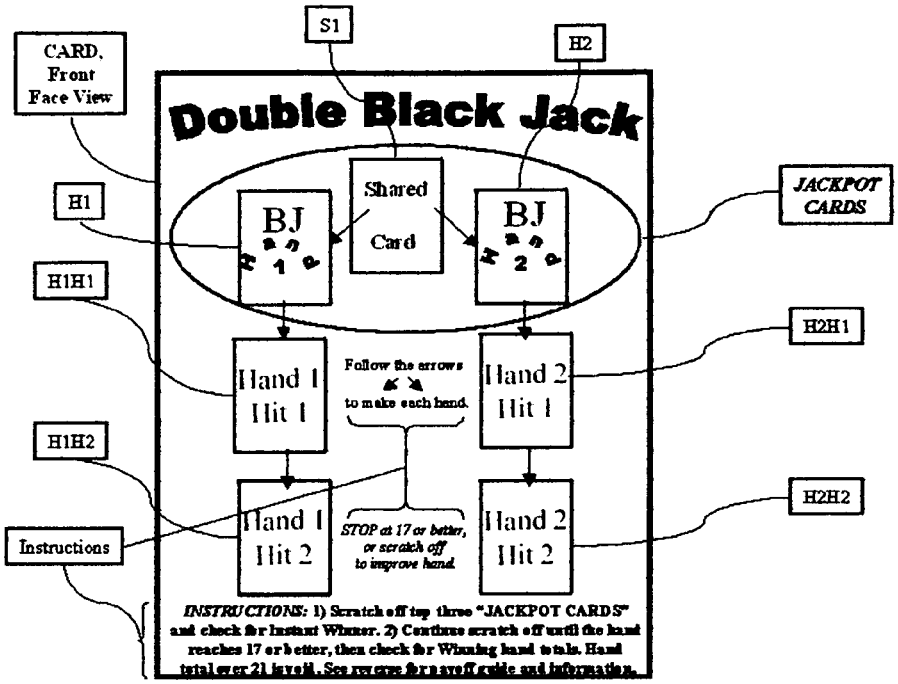
Figure 4
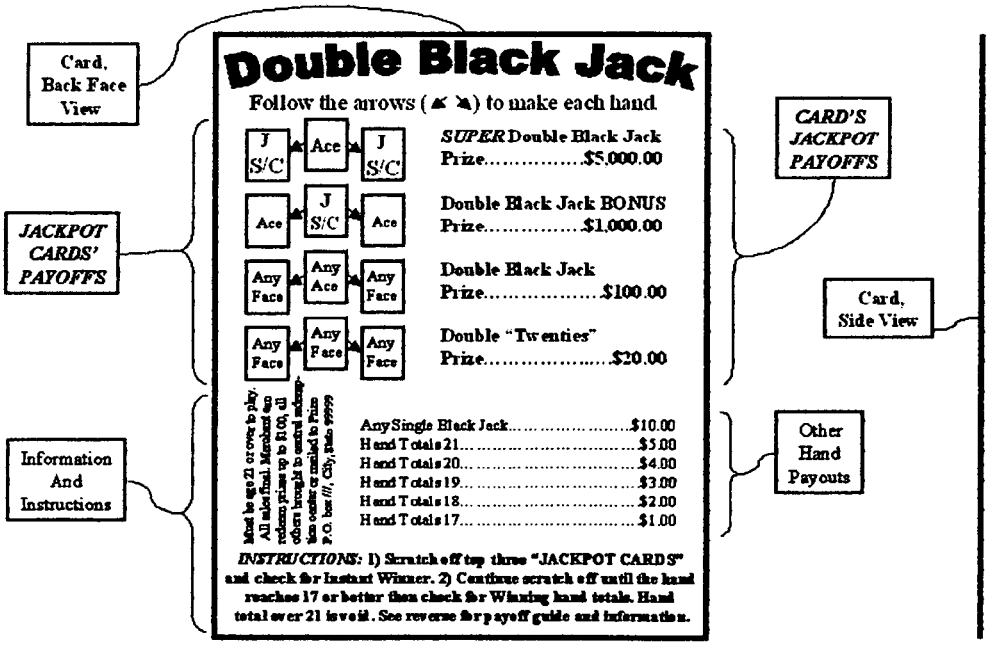
Figure 5
Figure 6

DOUBLE BLACK JACKS, A BLACKJACK TYPE GAME

CROSS-REFERANCE TO RELATED APPLICATIONS

This application claims benefit from my previous application for Provisional Patent Application No. 60/549,302, filed Mar. 2, 2004.

STATEMENT REGARDING FEDERALLY SPONSORED RESEARCH OR DEVELOPMENT

Not Applicable

REFERENCE TO A "SEQUENCE LISTING"

Not Applicable

BACKGROUND OF INVENTION

1. Field of the Invention

The present invention relates to games of chance, more specifically casino wagering games, and more particularly to Blackjack type card games that are suitable for use in gaming establishments.

2. Background of the Art

Blackjack is the most universally known and played card game in the world, whether it is called Blackjack, BJ, Twenty-one, vingt-et-un, pontoon or vanjohn. The main forms of this game (typically called Blackjack) consist of one or more players competing with either a changing bank—usually a private game amongst players, or a permanent bank—the typical casino game. There are a number of other variations offering different card values, and/or points count that the players attempt to reach. Seven and a half, Ten and a half, Macao, Fifteen and Farmer are interesting variants of the game.

Starting in the early 1960's, computer analysis of the game of Blackjack significantly affected future play and development of the game. Basic strategies and evaluations of cards played (counting methods) revealed that, under certain circumstances, there are advantageous plays or opportunities to increase wagers for the player to make while playing Blackjack. Thereafter, quick and not always attractive adjustments to dealing strategies, payouts, etc., have resulted in a game that is in constant change. Yet, the game remains popular to both the public and gaming operators. Casino operators are always looking for new games attractive to players, needing little explanation, offering multiple betting options, attractive payouts and fast paced, yet still retain an attractive hold or profit to the house.

More modern variations have added side bets such as "Pair Square™" (betting that the first two cards dealt the player match rank), or Spin the Wheel type games offering the player options when attaining certain hand totals. Other schemes offer alternatives such as the option to draw additional hands after a bust, or where multiple hands may be dealt to the dealer, where Blackjack hands evolve into poker hands, or community type BJ hands are dealt similar to Mini-Baccarat.

For example, U.S. Pat. No. 5,702,104 discloses a method of playing a mixture of Blackjack and Baccarat. A common card is dealt to the player where by treatment it creates two separate hands. The hands are pre-defined as one, a Blackjack hand, and the other a Baccarat hand. Then the dealer eventually receives two separate hands, one for Blackjack competition and the other for the Baccarat game. The only way the player wins his single wager is to beat the dealer in both hands. This is played out similar to Pai Gow. However, those who are familiar with these games realize there is no provision described allowing the splitting of pairs or the chance to double down in Blackjack. Further, there is no opportunity for the player to choose betting either the "Bank" or "Player" hand as traditionally offered in Baccarat. These limitations make this game less attractive to connoisseurs of either game.

A "Method of Playing Multiple Action Blackjack" is disclosed in an Oct. 13, 1992, patent issued to Richard A LeVasseur (U.S. Pat. No. 5,154,429). In this presentation, players are each dealt a single hand, with the dealer being dealt two consecutive hands. Play of the first and second dealer hands and the player hands are conventional, with each player allowed to place a wager on the outcome of each of the dealer hands. Each player uses the same hand against each dealer hand. Conventional Blackjack or twenty-one rules are otherwise used. This is a typical, recently offered variant of the game where a new "look" is given to the game, yet fails to offer a new or attractive large payout or a bonus round of play.

All this attempts to keep Blackjack competitive with newer card games being introduced. The focus is on the typical player who is most attracted to table games where they have some knowledge of the game and recognize an opportunity for good or the anticipation of great gain. This is best exemplified by the successes of "Three Card Poker™," "Let-It-Ride™," and "Caribbean Stud® Poker." These games have defined payouts and additional bonuses based on poker hands. Interestingly each has payouts topping out at 40 to 1 up to 1000 to 1, or progressive pots that can reach into the hundreds of thousands of dollars.

When trying to devise single or multi-level and attractive bonus schedules for the game of Blackjack, there is an inherent problem: its traditional format. There are only 1,326 initial two-card hands. In other words, there is little room for development.

Previous developments offer advancements such as a Fast Action Card (U.S. Pat. No. 5,320,356 issued to Glenn J. Cauda on Jun. 14, 1994). Here there is offered a game where a common card, referred to as the "Fast Action Card," Is common to the hands of each of players and the dealer. In other words, in this invention there is only one "Fast Action Card," or common/shared card, for use by all the participating players and the dealer as well, still leaving each with only a single two (2) card hand to play. All player and dealer hands develop from the combination of the "Fast Action Card" and the initial single card dealt to each player and the dealer. The idea of a common card is introduced here, but fails to fully develop. Any combinations are still limited to the evaluations of a single two (2) card hand.

The same is true for U.S. Pat. No. 6,726,427 issued to Jarvis in April of 2004, which discloses a method of playing a plurality of two (2) card hands against the dealer's single or multiple hands. The sequence of dealing the multiple hands, options allotted the players to elect additional hands, etc. are described. Here, four cards are dealt to the player to produce two hands. The multiple hands are each independent and still rely on the basic pool of 1,326 initial two card hands, making large bonus payouts difficult.

However, uniquely by the design of the present invention described herein, each participating player is initially dealt three cards that create at least two separate and playable hands. Specifically, one of those cards dealt to each player is considered a "shared card" in its relationship to each of the other two cards dealt to that player. The house is dealt one hand consisting of two cards. In addition, this present invention describes another aspect: the three cards initially dealt to each player, constructed and defined as at least two separate hands, may be treated separately in a Bonus game offered to the player for an additional or separate wager.

Thus, applying the present invention's initial card arrangement to the game, "Double Black Jacks" greatly enhances the original scope of 1,326 initial two card hand combinations in a single deck of fifty-two cards as described above, into 22,100 potential three-card combinations yielding 66,300 hand combinations. This field offers the imagination many levels and ranges for bonuses. By starting with three cards that produce two separate hands, and then proceeding into a game of "Double Black jacks," the present invention offers an attractive alternative and solution to the development of bonuses for "Double Black jacks" or other card games. Multiple decks of cards yield greater combinations proportionately.

U.S. Pat. No. 6,170,827 issued to Lombardo on Jan. 9, 2001, discloses a method of playing a card game where the player makes two wagers and receives three cards that can be arbitrarily arranged by the player into two separate groups. The dealer is dealt four cards, creating two separate hands. The player's cards will be played against the dealer's two hands in two separate comparisons. Should the play of the game result in a draw, this game allows the player to rearrange the player's hand to form a new competitive position. Aside from the complexity of first playing two player hands against two dealer hands, by design of the invention, players are allowed to touch and arbitrarily arrange these hands. This opens the door for professional cheats and is very difficult for a surveillance team to monitor. Only two (2) wagers are made resulting in two hands with no Bonus available based on the original three cards dealt the player.

Recently, Blackjack games with attractive bonuses have been introduced. U.S. Pat. No. 6,808,173 issued to Roger Snow in October of 2004, offers a game where, within a standard Blackjack game, players are offered an optional side bet. Players and the dealer are initially dealt two (2) card hands each. The bonus schedule reveals various awards based on the player's hand alone or with some combination of arrangement or appearance of cards in both the player and dealer's hands combined, if the optional side bet is properly placed for that outcome. Also, U.S. Pat. No. 6,854,731 issued to Saucier in February of 2005, discloses a Blackjack type card game where the player is offered an optional side wager. Each player is initially dealt a two (2) card. Should that hand in its first two card total the hand count of "20" as normally accepted in the game of Blackjack, a Bonus payout is due if the player properly placed the Bonus bet. Additional Bonus payouts are made based on the player's hand qualifying in a combination of cards in the dealer's hand, i.e., the player has two (2) queens and the dealer has a Blackjack. Both of the games described here rely on the simultaneous appearance of a particular array of cards in the combination of dealer and player's hands. There is only one bet for the player's hand and an optional side bet required to win the bonus.

Uniquely, by the design of the present invention, each player can make up to three separate and distinct wagers, which may or may not be dependent on each other. Further, each wager offers an attractive "house edge" on its own. In other words, the house or operator may offer a player the opportunity to place bets on the hands, or the Bonus wager, or both, with or without requiring that any one be equal to any of the others. Finally, these bets may be of any amount, subject only to table betting limits set by the house and are more easily monitored.

There are names and terms similar to that used in the present invention's title, "Double Black Jacks™", and have appeared in the marketplace. U.S. Pat. No. 5,882,259 issued to Holmes on Mar. 16, 1999, offers a method of playing a video game called BlackJack Poker. In one example (10), it offers a winning arrangement if the player receives the specific combination of two Blackjacks within the dealing of the five initial cards. Two or four of those cards may create all black, "Blackjack combinations." These two hands, derived from the initial dealing of five cards, are defined specifically as follows: 1) the combination of the Jack of Spades and the Ace of Spades, and 2) the combination of the Jack of Clubs and the Ace of Clubs. These are considered pre-designated winning arrangements if the player is dealt one or both of these "two all black Blackjack combinations on the initial deal." Payouts are made should the player receive either or both of these combinations according to Example 10 under the tier of "DOUBLE BLACKJACK," according to the number of coins bet. Play then continues with the player having the option to discard unwanted cards, receive replacements and continue into a game of poker.

Considering all the above, the present invention brings the standard game of Blackjack to a new level and produces an attractive "win-win" scenario. The player is offered multiple wagers on a game known and understood. Play is enhanced with a new and attractive Bonus scheme on the game. The present invention offers an attractive gaming platform with multiple betting options, speed, and little or no exposure to any "counting" strategy. "Double Black Jacks™." or "Mississippi Blackjack," as it may be called, offers a new and unique multi-level bonus payout based on traditional Blackjack with an attractive payout scale. All this results in inducing player participation while retaining an attractive hold or profit for the house.

SUMMARY OF INVENTION

Suitability for play in gaming establishments is driven by the requirement games be approved by regulatory bodies that control gaming. That approval process includes proving the mathematical basis of the probabilities that give odds which in turn are used to calculate payout tables and predict the house edge. House edge is the percentage of each wager, whether the player wins or looses, that will be retained by the house. Drop is a term that refers to the money that is taken in at a table in exchange for chips or credits. Hold is the percentage of drop retained by the house when the table is closed and the original table finding is reconciled. The attractiveness of a game to gamblers is what produces hold as every gambler thinks they can beat the house edge. To survive in the casino environment the game must recognizable, easy to learn and fast paced. Tying known game patterns and connective terminology to a new game provides recognition, gives a quick learning curve and simplicity promotes a fast pace.

The basis of this game is three cards dealt to each player in a uniform manner face up. The cards may be dealt in any order so long as it is the same for each player. The real statistical difference is that one card must be designated as a shared card but it can be given any title. There are four of each denomination of a standard playing card deck, one in each suit. However, there are only two of each denomination that are of the same color. Therefore the game could be played by requiring that the shared card, be a seven and the other two cards must be red threes. The probabilities of that combination is the same as requiring the shared card to be an Ace and the other two cards must be Jacks which are black. However, the public readily recognizes an Ace with a face card or ten. Therefore for the sake recognition, the designated winning hands in this game are based around cards and terminology from the common game of blackjack. The payout schedules in this game is associated with phrasing and card names the public recognizes. The recognition of certain card patterns has risen to the point of power as demonstrated by the resistance one will find if they attempt to convince an average casino player that a seven and two red threes has the same probabilities of being dealt from a shuffled deck as an Ace and two black Jacks.

Common blackjack begins with the player and dealer receiving two cards. The player competes against the dealer/house. Choosing whether to take more cards gives the player the illusion of control and skill. In blackjack the main skill that could influence the outcome is card counting which most casinos have instituted rules and procedures to prevent. The current invention can be played and then the casino may offer to continue into another game that does offer strategy. This combination gives the best of both worlds, very high odds in the three card analysis and the opportunity to continue into another game that does involve strategy or at least the perception of strategy.

Each player receives three cards that are dealt in a manner to designate one of them as a shared card and the other cards as card one and card two. The order in which these are dealt does not affect the probabilities so long as it is uniform among the players. Probabilities based on card combinations are empirical and should be the same regardless of who makes the calculations but specific to this game the order of dealing must be factored in. The calculations to derive the house edge for a hierarchy of winning hands involves backing in a payout for a particular winning hand that will drive the payouts in the other hands. The composite edge must fall within a range acceptable to gaming authorities. If it does not, a payout must be altered and the table must be recalculated until an appropriate edge is derived. Many different payouts may be calculated and further may be calculated for multiple deck dealing. Shown below is are two table that describes a hierarchy of winning hands with a title for the hand, a description of the required cards and a payout associated with each winning hand.

ONE DECK

| | | | payouts 1 deck | |
|---|---|---|---|---|
| Title | Description | Probability | 1 | 2 |
| 1. SUPER "Double Black Jacks ™" | Shared card is any Ace; card one And two are the Jack of Spades or Clubs | 0.006% | 500:1 | 500:1 |
| 2. "Double Black Jacks" Bonus | Shared card is a Jack of Spades or Clubs card one and two are any Ace | 0.018 | 150:1 | 150:1 |
| 3. Double Splits | Shared card, card one and two are the Same denomination | 0.235 | 20:1 | 30:1 |
| 4. Double Blackjacks | Shared card is an Ace; card one and two are 10 value cards | 0.845 | 4:1 | 5:1 |
| 5. Double 20s | Shared card is an Ace; card one and card two are 9 value cards or Shared card is a 9 value card and card two and three are Aces | 2.534 | 3:1 | 3:1 |
| 6. Single blackjack | Shared card is an Ace; only card one or two is a 10 value card or Shared card is a 10 value card and only card one or two is an Ace | 7.916 | 2:1 | 2:1 |
| 7. Pair | Shared card and either card one or two is a pair | 11.584 | 1:1 | 1:1 |
| 8. Low | Shared card and card one and two are any combination not listed above | 76.863% loss | −1:1 | −1:1 |
| | composite house edge | | 3.54% | 2.45% |

-continued

| TWO DECKS | | | |
|---|---|---|---|
| | | payouts 2 deck | |
| Title | Probability | 1 | 2 |
| 1. SUPER "Double Black Jacks ™" | 0.006% | 500:1 | 500:1 |
| 2. "Double Black Jacks" | 0.018 | 100:1 | 100:1 |
| 3. Double Split | 0.235 | 15:1 | 15:1 |
| 4. Double Blackjacks | 0.845 | 4:1 | 4:1 |
| 5. Double 20s | 2.534 | 1:1 | 1:1 |
| 6. Single blackjack | 7.916 | 1:1 | 1:1 |
| 7. Pair | 11.584 | 1:1 | 1:1 |
| 8. Low | 76.863% loss | −1:1 | −1:1 |
| composite house edge | | 4.03% | 2.57% |

After the above analysis is completed each player has three cards face up on the table. Another game offered by the casino may commence at this point that would utilize those cards as a starting point and proceed according to its own rules. Transition rules can also be applied to add or delete cards to accommodate any game that needs to start with less or more cards.

In another embodiment blackjack is the other game offered by the casino after the "Double BlackJacks™" analysis is preformed. In this embodiment the bet is divided in three equal portions that are associated with the shared card, card one and card two. If the player wins according to a "Double Black Jacks™" payout, the payout is calculated from the wager associated with the shared card. Then according to blackjack rules, two hands are analyzed by using the shared card in separate combination with card one and card two to make two blackjack hands. The house payout for blackjack is then compared to each hand and the winnings are removed to the player. If both hands are blackjack winners all three cards are collected and the round is over for that player. If only one hand is a blackjack winner then the hand card for that hand is collected. The analysis of"Double Black Jacks™" and the first blackjack analysis are simultaneous as the dealer completes those steps with each successive player. Then the players compete with the dealer according to the casino rules for the hands remaining on the table. Some blackjack hands will not appear in this game such as splitting pairs because those cards were reconciled and removed in the "Double Black Jacks™" analysis.

The invention also provides game apparatus for use in playing the card-type games of the present invention. For example, the games of the present invention are readily adaptable of play as a board game, "scratch-off" card game, computer generated game, or on a gaming device such as video or slot gaming devices common to the gaming industry. For example, one aspect of the present invention comprises an apparatus for playing a card-type game comprising some type of display element including, but not limited to, a board, screen, table cards, play cards, a play sheet, slot or other gaming device, etc., for informing at least one player of a hierarchy of possible hands and a predetermined plurality of winning combinations. Further, an area or position for receiving at least one wager selection from a plurality of wagering options by at least one player, wherein the wagering comprises whether a player's hand attains at least one of said predetermined plurality of winning combinations; and a surface for display area for displaying a plurality of indicia of playing cards to form at least one or more of the player's hands placed in to play.

BRIEF DESCRIPTION OF DRAWINGS

FIGS. 2 and 2*a*. illustrate examples of the disclosure of the Bonus Bet Payouts for the first three cards, creating two hands, dealt to each player where the player has made an appropriate wager.

FIGS. 3 and 3*a*. are views of one player's position showing the areas for the placement of cards dealt and wagers made.

FIG. 4 reveals the face of a peel-off or scratch-off card representing another embodiment of the present invention, "Double Black jacks."

FIG. 5 displays the back or reverse side of the card illustrated in FIG. 4.

FIG. 6 shows a side view of the same card from FIGS. 4 and 5 above and is of a normal thickness for cards so used in the industry.

DETAILED DESCRIPTION OF THE INVENTION

Figure 1:
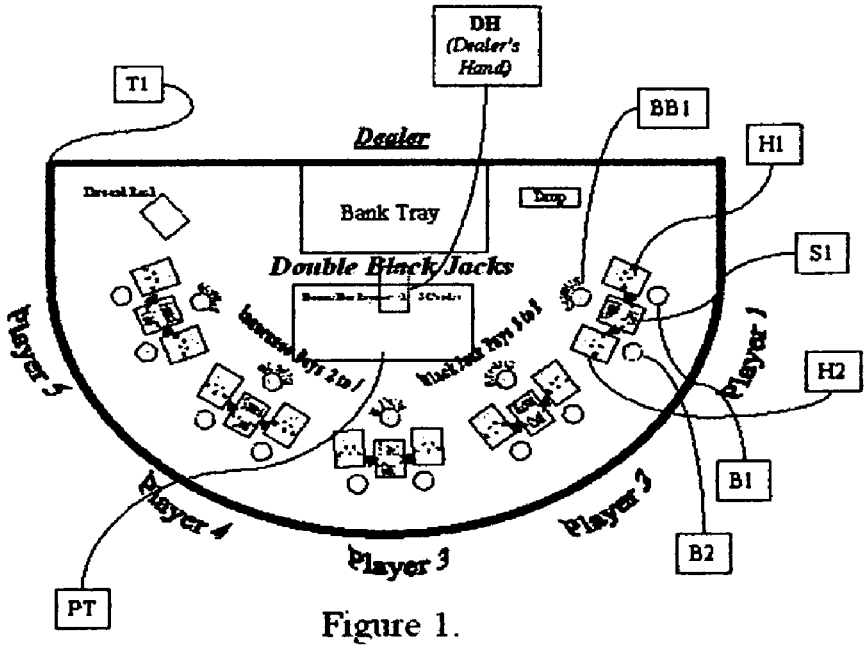
FIGS. 1 and 1*a*. show playing surfaces for use in playing "Double Blackjacks," one embodiment of the present invention.
Figure 1A:
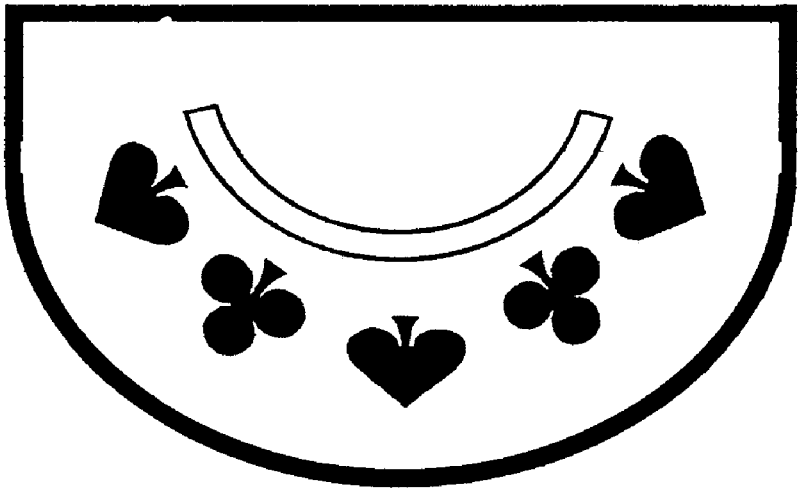

FIGS. 1 and 1*a*. disclose views of a table game layout T1 providing for the playing of the present invention's card game. These are readily adaptable to any gaming establishment's typical card game table and operation. Note that although only five player positions are shown, they represent a total of ten playing hands, approximately 40% more than is found on a typical gaming table with an initial maximum of seven hands of blackjack. or any other card game available for play. Additional Bonus bets make the game and layout more attractive.

FIG. 3 and 3*a*. illustrate detail examples of a typical player's position. The Shared Card S1 is intuitively positioned in the middle. From the players prospective Card one H1 is positioned to the right of S1 and Card Two H2 is positioned to the left of S1 as many games are dealt from left to right of the dealer's perspective. Also shown are wager positions BB1, B2 and B3. When "Double Black Jacks™" is followed with blackjack as the other game offered by the casino the player will place three equal bets in each position. As that embodiment is played the cards of S1, H1 and H2 are analyzed by the "Double Black Jack™" rules and they will also be treated as two blackjack hands. S1 and H1 will be treated as one blackjack hand as will S1 and H2. If a player wins according to payout titles 1, 2 or 4 they are also paid for two "blackjack" wins according to the casino's blackjack rules and their cards are removed. It is very common to find casinos pay 3:2 for a "blackjack" hand; hard 21, an Ace and a 10 value card and 1:1 for a "winning hand" which is usually 21 by three or more cards. If a player wins according to payout titles 3 or 5 they are also paid for two "winning" hand according to the casino's blackjack rules and their cards are removed. If player wins according to payout titles 6 and 7 they are paid for one "winning" hand according to the casino's blackjack rules and the H1 or H2 card involved in the win is collected and the BB1 and B2 or B3 wager and winnings are removed to the player. The player will then proceed to play S1 with the H1 or H2 card left on the table along with the B2 or B3 associated wager against the dealer according to the casino's blackjack rules. If the player had any combination of cards not described by payout titles 1 through 7 their BB1 wager is collected and that player will proceed to play S1 and H1 as a blackjack hand with wager B2 and S1 and H2 as a blackjack hand with wager B3 against the dealer according to the casino's blackjack rules.

If the casino offers another game which is not according to its blackjack rules, the placement of wagers other that the "Double Black Jacks™" wager will be made according to the rules of the other game. Generally the "Double Black Jacks™" wager will be placed on BB1. The "Double Black Jacks™" analysis will be completed and then the other game will commence.

When the above wagers are in place, the cards are Shuffled. The cards are dealt to the participating players, with each player receiving an initial total of three cards usually face up (exposed) The cards maybe dealt to the player and the house in any order. After the "Double Black Jacks™" analysis the players and the dealer will receive or lose cards according to the rules of another game offered by the casino.

Then the player and dealer compare the initial three cards dealt the player in positions H1, S1 and H2, to the Payout PT disclosed in FIG. 1, 2 or 2*a*. A payout schedule such at PT should be displayed in a convenient manner and location readily available to each player and able to be viewed by the dealer and casino management staff. When the player has wagered BB1 (B3 in FIG. 3*a*), and qualifies for one of the payouts indicated, the dealer shall pay the player according to the schedule example PT or other payout table calculated according to the probabilities and desired house edge provided. The procedure described in this paragraph is repeated in turn with each participating player at the table T1.

The table layouts may be varied, such as by offering more or less player positions than those shown, the shapes, components or their positions on the table layout may change, the rules varied, or additional rules imposed, it still remains that these variations are within the scope of the present invention.

Now referring to FIG. 4, 5 and 6, other embodiments of the present invention "Double Black Jacks" is seen to relate to and otherwise could be utilized as part of other commonly used devices in the gaming industry as a wagering game.

For example, FIG. 4 relates to a peel-off or scratch-off card type game. In this application, a game card of nay size normally used, is inscribed on the front as shown in FIG. 4 and on the back as shown on FIG. 5 with a thickness approximately that of a typical playing card represented by FIG. 6.

Once the player purchases, or through some other means acquires this card, the "JACKPOT CARD" (on FIG. 4 shown as S1, H1 and H2 ) are revealed through methods familiar to the industry of scratching or peeling the card in the designated areas. The revealed symbols are compared to the "JACKPOT CARD PAYOFFS" or "Other Hand Payoffs" as shown on FIG. 5. These designates conform to claim 3, or any obvious variation of the same. When a comparison is a match, the player has won the indicated payoff or that defined by the issuer. The game may continue to another round or terminate as designed by the issuer.

Figure 7:
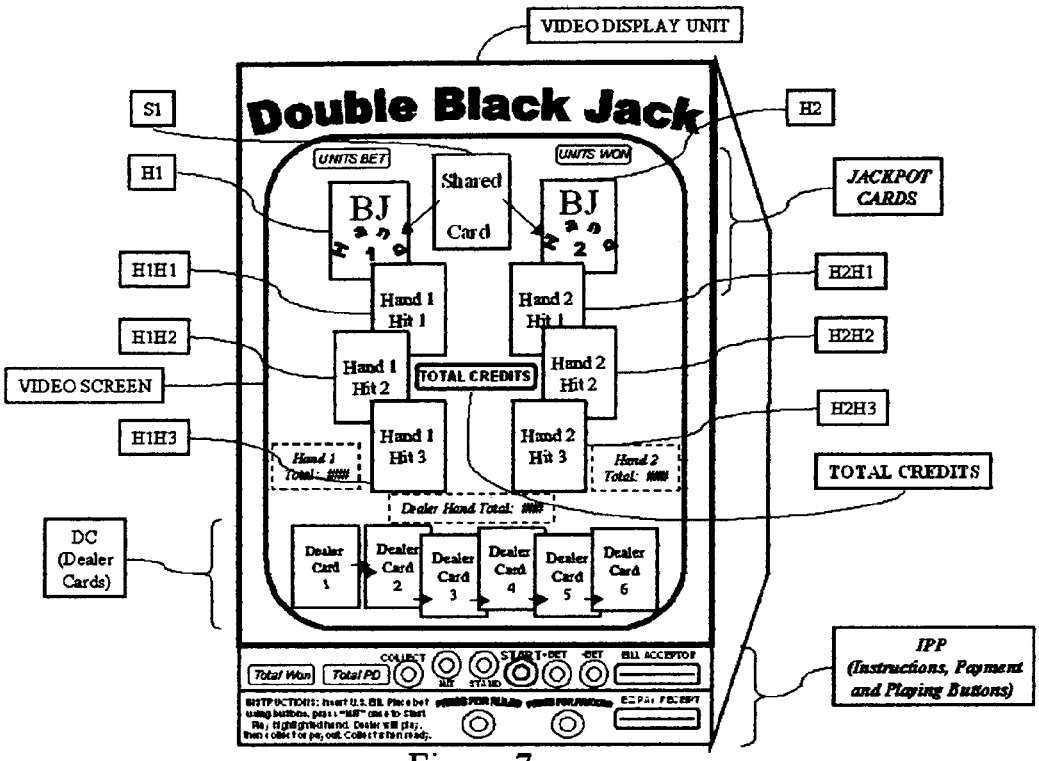
FIG. 7 is another embodiment of the present invention illustrating a VIDEO DISPLAY UNIT offering a game based on the present invention, "Double Black jacks."

Now Referring to FIG. 7, we see a "VIDEO DISPLAY UNIT," representing an example of other embodiments of the present invention, whether it be any one of the following: 1) a video game, 2) an electromechanical machine (slot or otherwise), a purely mechanical machine, or 3) any electronic slot machine application, video produced or otherwise. The design of the game conforms to that described within claims 1 through 5.

From the present descriptions, those skilled in the art will appreciate that various modifications may be made without department from the scope of the present invention. For example, the naming of the wagers, the naming and/or ranking of any hand, the payout schedule, amounts to be paid, as well as predetermined winning or losing ranks all may be varied in accordance with the requirements of he gaming establishment or producer, yet remain within the scope of the present invention.

What is claimed:

1. A new method of playing a three card game involving one or more persons or entities acting as a dealer and/or banker and at least one player generally based on at least one 52 card standard playing deck or indicia of playing cards or its suit and denomination equivalent based on calculated probabilities of specific three card combinations being dealt in a specific order and in combination with a predetermined payout schedule defining odds for those three card combinations also giving predictable house edges, played by the steps comprising:

a. establishing a gaming platform with at least one dealer station with convenient access to all of at least one player station associated with said dealer station;

b. establishing a dealer who represents the bank/house;

c. establishing at least one player associated with at least one player station;

d. said dealer preparing said gaming platform and cards for a round of the game;

e. declaring what other game offered by the casino will be offered, if any;

f. requiring said player(s) to place a wager for each player station they play without regard to amounts they play at alternate stations or other player's wagers and a wager(s) for the follow-on game if any;

g. uniformly dealing three cards face up to each active player station in a manner or by a means to fix dealt card designation as shared card, card one, and card two;

h. prohibiting a player from re-designating any card;

i. said dealer then examining each active player station's hand according to the rules consisting of:

r1. if a player station's shared card is an Ace and both said card one and card two is the Jack of Spades or Jack of Clubs, the player is paid the first level, highest, payout of said payout schedule and the wager and winnings are removed to that player; else r2. if a player station's shared card is the Jack of Spades or Jack of Clubs and said card one and card two are Aces, the player is paid the second level payout of said payout schedule and the wager and winnings are removed to that player; else r3. if a player station has three of a kind the player is paid the third level payout of said payout schedule and the wager and winnings are removed to that player; else r4. if a player station's shared card is an Ace and card one and two are both ten valued cards or if shared card is a ten value card and both card one and two are Aces, the player is paid the fourth level of said payout schedule and the wager and winnings are removed to that player; else r5. if a player station's shared one is an Ace and card one and two are both 9 value cards or if shared card is a 9 value card and both card one and two are Aces, the player is paid the fifth level payout of said payout schedule and the wager and winnings are removed to that player; else r6. if a player station's shared card is an Ace and only card one or two is a 10 value card or if shared card is a 10 value card and only card one or two is an Ace, the player is paid the sixth level payout of said payout schedule and the wager and winnings are removed to that player; else r7. if a player station's shared card in combination with only card one or two is a pair, the player is paid the seventh level payout of said payout schedule and the wager and winnings are removed to that player; else r8. if a player station's cards are any combination other that r1 through r7 above, the wager is collected by the house; and j. after the dealer examines all active player stations associated with said dealer station in a uniform manner the other game offered by the casino, if any, begins with the cards the players are holding and the initial other game offered by the casino wager according to the house rules for that game until completion and another round is offered.

2. The method of claim 1 further comprising said game played with one deck of cards or equivalent symbols wherein said probabilities of each winning hand and "Double Black Jacks" payout schedule and the composite house edge includes the following by example of about:

| hand analysis | probability | payout | OR | payout |
|---|---|---|---|---|
| r1 | 0.006% | 500:1 | | 500:1 |
| r2 | 0.018 | 150:1 | | 150:1 |
| r3 | 0.235 | 20:1 | | 30:1 |
| r4 | 0.845 | 4:1 | | 5:1 |
| r5 | 2.534 | 3:1 | | 3:1 |
| r6 | 7.916 | 2:1 | | 2:1 |
| r7 | 11.584 | 1:1 | | 1:1 |
| r8 | 76.863% | −1:1 (loss) | | −1:1 |
| composite house edge | | 3.52% | | 2.45%. |

3. The method of claim 1 further comprising said game played with two decks of cards or equivalent symbols wherein said probabilities of each winning hand and "Double Black Jacks" payout schedule and the composite house edge includes the following by example of about:

| hand analysis | probability | payout | OR | payout |
|---|---|---|---|---|
| r1 | 0.006% | 500:1 | | 500:1 |
| r2 | 0.018 | 100:1 | | 100:1 |
| r3 | 0.235 | 15:1 | | 15:1 |
| r4 | 0.845 | 4:1 | | 3:1 |
| r5 | 2.534 | 1:1 | | 2:1 |
| r6 | 7.916 | 1:1 | | 1:1 |
| r7 | 11.584 | 1:1 | | 1:1 |
| r8 | 76.863% | −1:1 (loss) | | −1:1 |
| composite house edge | | 4.03% | | 2.57%. |

4. The method of claim 1 wherein said means to fix dealt card designation comprises a surface with indicia locating said dealer station and said player station(s) and designating dealt cards as a shared card, a card one and a card two and to locate the wagers and other predetermined designations to assist conducting said other game offered by the casino by said house rules.

5. The method of claim 1 further comprising adapting said method to other gaming media including digital/visual, scratch or pull tab cards, board game and any other system of presenting card based games.

6. The game of claim 1 continued with a other game offered by the casino of blackjack further comprising;

requiring the player to have place 3 equal original wagers;

the dealer continuing to examine each player station's cards by the rule steps comprising:

rA. if a player station won according to said r1, r2 or r4, the player is paid two payouts each equal to a blackjack win on a hard 21, ace plus ten value card, according to the casino's blackjack rules and the current round of the game is over as to that player station, that player station's cards are collected and its wagers and winnings are removed to that player; else rB. If a player station won according to said r3, r5, the player is paid two payouts each equal to a blackjack win on a soft 21, three or more cards to make 21, according to the casino's blackjack rules and the current round of the game is over as to that player station, that player station's cards are collected and its wagers and winnings are removed to that player, else rC. If player station won according to said r6, the player is paid one payouts each equal to a blackjack win on a soft 21, three or more cards to make 21, according to the casino's blackjack rules and the Ace or 10 value card that is in the card one or two position is collected and one wager and the winnings are removed to that player and after this round is complete for all player stations the player may continue to play the remaining two cards with that station's remaining wager against the house in accordance with its blackjack rules; else rD. If player won according to said r7, the player is paid one payout equal to a blackjack win on a soft 21, three or more cards to make 21, according to the casino's blackjack rules and the Ace or 10 value card that is in the card one or two position is collected and one wager and the winnings are removed to that player and after this round is complete for all player stations the player may continue to play the remaining two cards with that station's remaining wager against the house in accordance with its blackjack rules; or rE. If player did not win per said r8, shared card and card two will be treated as a separate blackjack hand with its associated remaining wager and shared card and card one will be treated as a separated blackjack hand with its associated remaining wager and the player may continue to play each hand separately against the house in accordance with its blackjack rules; and After the dealer examines all active player stations associated with said dealer station in a uniform manner, the dealer proceeds to play each remaining blackjack hand in accordance with the house blackjack rules until all hands are completed and another round of the game of claim 1 is offered.

7. A new method of playing a three card game, involving one or more persons or entities acting as a dealer and/or banker and at least one player generally based on one 52 card standard playing deck or indicia of playing cards or its suit and denomination equivalent based on calculated probabilities of specific three card combinations being dealt in a specific order and in combination with a predetermined payout schedule defining odds for those three card combinations also giving predictable house edges, played by the steps comprising:

a. establishing a gaming platform with at least one dealer station with convenient access to all of at least one player station associated with said dealer station;

b. establishing a dealer who represents the bank/house;

c. establishing at least one player associated with at least one player station;

d. said dealer preparing said gaming platform and cards for a round of the game;

e. declaring that blackjack will be the other game offered by the casino;

f requiring said player(s) to place three equal wagers for each player station they play without regard to amounts they play at alternate stations or other player's wagers;

g. uniformly dealing three cards face up to each active player station in a manner or by a means to fix dealt card designation as shared card one, and card two;

h. prohibiting a player from re-designating any card;

i. said payout schedule and the composite house edge includes the following by example of about:

| hand analysis | probability | payout | OR payout |
|---|---|---|---|
| r1 | 0.006% | 500:1 | 500:1 |
| r2 | 0.018 | 150:1 | 150:1 |
| r3 | 0.235 | 20:1 | 30:1 |
| r4 | 0.845 | 4:1 | 5:1 |

-continued

| hand analysis | probability | payout | OR payout |
|---|---|---|---|
| r5 | 2.534 | 3:1 | 3:1 |
| r6 | 7.916 | 2:1 | 2:1 |
| r7 | 11.584 | 1:1 | 1:1 |
| r8 | 76.863% | −1:1 (loss) | −1:1 |
| composite house edge 3.52% | | | 2.45% |

j. said dealer then examining each active player station's hand according to the rules consisting of:

r1. if a player station's shared card is an Ace and both said card one and card two is the Jack of Spades or Jack of Clubs, the player is paid the first level, highest, payout of said payout schedule and the wager and winnings are removed to that player; else r2. if a player station's shared card is the Jack of Spades or Jack of Clubs and said card one and card two are Aces, the player is paid the second level payout of said payout schedule and the wager and winnings are removed to that player; else r3. if a player station has three of a kind the player is paid the third level payout of said payout schedule and the wager and winnings are removed to that player; else r4. if a player station's shared card is an Ace and card one and two are both ten valued cards or if shared card is a ten value card and both card one and two are Aces, the player is paid the fourth level of said payout schedule and the wager and winnings are removed to that player, else r5. if a player station's shared card is an Ace and card one and two are both 9 value cards or if shared card is a 9 value card and both card one and two are Aces, the player is paid the fifth level payout of said payout schedule and the wager and winnings are removed to that player; else r6. if a player station's shared card is an Ace and only card one or two is a 10 value card or if shared card is a 10 value card and only card one or two is an Ace, the player is paid the sixth level payout of said payout schedule and the wager and winnings are removed to that player; else r7. if a player station's shared card in combination with only card one or two is a pair, the player is paid the seventh level payout of said payout schedule and the wager and winnings are removed to that player; else r8. if a player station's cards are any combination other that r1 through r7 above, the wager is collected by the house; and k. the dealer continuing to examine each player station's cards by the follow-on rule steps comprising:

rA if a player station won according to said r1, r2 or r4, the player is paid two payouts each equal to a blackjack win on a hard 21, ace plus ten value card, according to the casino's blackjack rules and the current round of the game is over as to that player station, that player station's cards are collected and its wagers and winnings are removed to that player; else rB. If a player station won according to said r3, r5, the player is paid two payouts each equal to a blackjack win on a soft 21, three or more cards to make 21, according to the casino's blackjack rules and the current round of the game is over as to that player station, that player station's cards are collected and its wagers and winnings are removed to that player, else rC. If player station won according to said r6, the player is paid one payouts each equal to a blackjack win on a soft 21, three or more cards to make 21, according to the casino's blackjack rules and the Ace or 10 value card that is in the card one or two position is collected and one wager and the winnings are removed to that player and after this round is complete for all player stations the player may continue to play the remaining two cards with that station's remaining wager against the house in accordance with its normal blackjack rules; else rD. If player won according to said r7, the player is paid one payouts each equal to a blackjack win on a soft 21, three or more cards to make 21, according to the casino's blackjack rules and the Ace or 10 value card that is in the card one or two position is collected and one wager and the winnings are removed to that player and after this round is complete for all player stations the player may continue to play the remaining two cards with that station's remaining wager against the house in accordance with its blackjack rules; or rE. If player did not win per said r8, shared card and card two will be treated as a separate blackjack hand with its associated remaining wager and shared card and card one will be treated as a separated blackjack hand with its associated remaining wager and the player may continue to play each hand separately against the house in accordance with its blackjack rules; and After the dealer examines all active player stations associated with said dealer station in a uniform manner, the dealer proceeds to play each remaining blackjack hand in accordance with the house blackjack rules until all hands are completed and another round of the game of claim 1 is offered.

8. The method of claim 7 further comprising said game played with two decks of cards or equivalent symbols wherein said probabilities of each winning hand and "Double Black Jacks" payout schedule and the composite house edge includes the following by example of about:

| hand analysis | probability | payout | OR payout |
|---|---|---|---|
| r1 | 0.006% | 500:1 | 500:1 |
| r2 | 0.018 | 100:1 | 100:1 |
| r3 | 0.235 | 15:1 | 15:1 |
| r4 | 0.845 | 4:1 | 3:1 |
| r5 | 2.534 | 1:1 | 2:1 |
| r6 | 7.916 | 1:1 | 1:1 |
| r7 | 11.584 | 1:1 | 1:1 |
| r8 | 76.863% | −1:1 (loss) | −1:1 |
| composite house edge 4.03% | | | 2.57%. |

9. The method of claim 7 wherein said means to fix dealt card designation comprises a surface with indicia locating said dealer station and said player station(s) and designating dealt cards as a shared card, card one and card two and to locate the wagers and other predetermined designations to assist conducting said other game offered by the casino by said house rules.

10. The method of claim 7 further comprising adapting said method to other gaming media including digital/visual, scratch or pull tab cards, board game and any other system of presenting card based games.

* * * * *